US010197289B2

(12) United States Patent
Kim

(10) Patent No.: US 10,197,289 B2
(45) Date of Patent: Feb. 5, 2019

(54) CONTROL ASSEMBLY AND COOKING APPARATUS HAVING THE SAME

(71) Applicant: LG ELECTRONICS INC., Seoul (KR)

(72) Inventor: Youngjin Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 270 days.

(21) Appl. No.: 15/154,674

(22) Filed: May 13, 2016

(65) Prior Publication Data

US 2016/0334111 A1 Nov. 17, 2016

(30) Foreign Application Priority Data

May 15, 2015 (KR) ..... 10-2015-0068116

(51) Int. Cl.
*H05B 6/64* (2006.01)
*H05B 6/66* (2006.01)
*F24C 7/08* (2006.01)

(52) U.S. Cl.
CPC ..... *F24C 7/086* (2013.01)

(58) Field of Classification Search
CPC ..... H05B 6/64–6/808; F24C 7/02–7/046
USPC ..... 219/702–724
See application file for complete search history.

(56) References Cited

U.S. PATENT DOCUMENTS 7,026,589 B2 * 4/2006 Kim ..... H05B 6/6435 219/702
2010/0163549 A1 * 7/2010 Gagas ..... H05B 6/1209 219/622
2012/0281374 A1 * 11/2012 Lee ..... F24C 7/082 361/756

FOREIGN PATENT DOCUMENTS

| | | | |
|---|---|---|---|
| JP | 2002-39537 | A | 2/2002 |
| JP | 2013-112018 | A | 6/2013 |
| KR | 10-0365922 | B1 | 12/2002 |
| WO | 2011/090223 | A1 | 7/2011 |

* cited by examiner

*Primary Examiner* — Michael Laflame, Jr.
(74) *Attorney, Agent, or Firm* — Dentons US LLP

(57) ABSTRACT

Provided is a cooking apparatus and a touch sensor assembly of the cooking apparatus, including an outer cover formed of a metal material and forming an exterior of the cooking apparatus; and a touch module mounted on a rear side of the outer cover to be contacted therewith and including a plurality of touch sensors, wherein a touch unit is formed in an opening of a rear side of the outer cover that contacts to the touch sensor and is elastically deformed with ease when touched by a user to transfer the pressure to the touch sensor.

23 Claims, 8 Drawing Sheets

CONTROL ASSEMBLY AND COOKING APPARATUS HAVING THE SAME

CROSS-REFERENCE TO RELATED APPLICATIONS

The present application claims priority under 35 U.S.C. 119 and 35 U.S.C. 365 to Korean Patent Application No. 10-2015-0068116 (filed on May 15, 2015), which is hereby incorporated by reference in its entirety.

BACKGROUND

Generally, a cooking apparatus is an appliance to cook food using a gas or electricity. Such a cooking apparatus includes an operating unit to operate the same, and a variety of settings and operations of the cooking apparatus can be performed by the operating unit.

Recently, a variety of foods can be cooked using the cooking apparatus, so that a structure of the operating unit capable of setting and operating a variety of functions is under the development.

Typically, the Korean Patent Laid-Open No. 10-2009-0082624 discloses a cooking apparatus in which a touch-type control panel is provided and a variety of functions can be set and operated by touch. Further, the control panel of the cooking apparatus has a structure in which a touch operated capacitive keypad is arranged on the rear side of a glass panel.

Further, the U.S. Pat. No. 5,995,877 discloses a control unit in which a film having a piezo-sensor built in the rear side of a plane-shaped control surface is provided and the film is connected to a printed circuit board through a connector to enable an operation signal to be inputted when a user operates the control surface.

There are problems in such conventional technologies that a sensor, a keypad having a sensor attached thereto or a film should be attached to a precise position on an operational surface to make a precise recognition when operated by a user, and a bad recognition occurs when they are not attached to the precise position.

SUMMARY

According to an embodiment, there is provided a control assembly and a cooking apparatus having the control assembly, capable of mounting a printed circuit board having a touch sensor built in the precise position on the rear side of a cover plate on which an operating unit is formed, thereby increasing an operation reliability.

Further, according to another embodiment, there is provided a control assembly and a cooking apparatus having the control assembly, capable of mounting a printed circuit board in which a touch sensor is mounted, on a precise position by assembling the printed circuit board to a body panel without a separate zig, thereby increasing productivity and reducing an error rate.

According to an embodiment of the present disclosure, there is provided a control assembly, including a cover plate configured to form an exterior, a printed circuit board configured to be included on a rear side of the cover plate and to include a touch sensor mounted thereon, a bonding member configured to be applied between the cover plate and the printed circuit board to bond the both, a body panel configured to be coupled with the cover plate and to receive the printed circuit board therein, and a printed circuit board opining configured to insert the printed circuit board into the body panel and to be formed in the same shape as a circumference of the printed circuit board.

According to another embodiment of the present disclosure, there is provided a cooking apparatus having a control assembly, including a body configured to form a cooking space, a door configured to be mounted in the body to open and close the cooking space, and a control assembly configured to be included in the front side of the body and to be operated by a user for operation setting and operations, wherein the control assembly includes a cover plate configured to form an exterior, a printed circuit board configured to be included on a rear side of the cover plate and to include a touch sensor mounted thereon, a bonding member configured to be applied between the cover plate and the printed circuit board to bond the both, a body panel configured to be coupled with the cover plate and to receive the printed circuit board therein, and a printed circuit board opining configured to insert the printed circuit board into the body panel and to be formed in the same shape as a circumference of the printed circuit board.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail net necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 1:
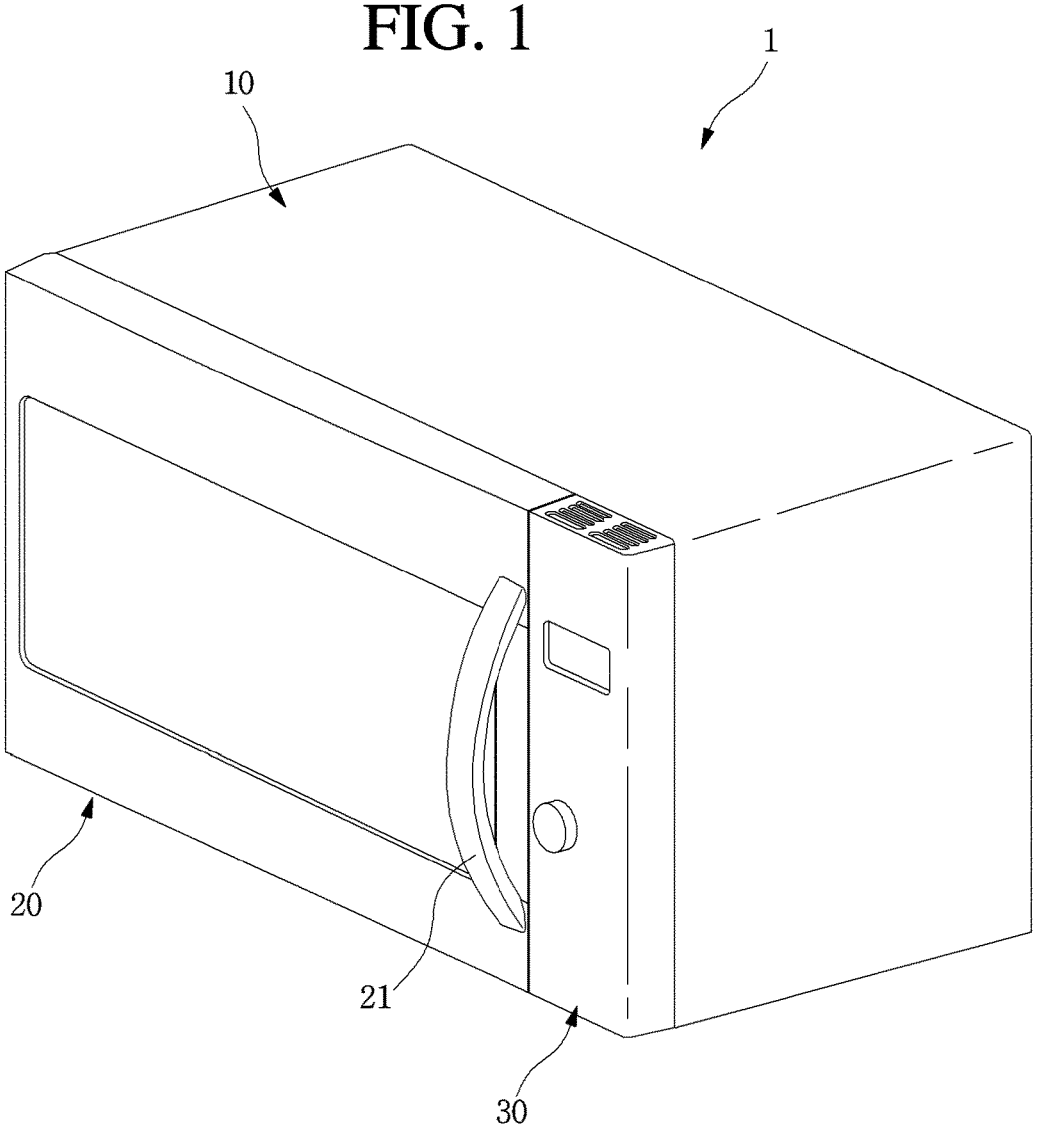
FIG. 1 is a perspective view of a cooking apparatus according to an embodiment of the present disclosure.

FIG. 1 is a perspective view of a cooking apparatus according to an embodiment of the present disclosure.

As illustrated in the drawing, a cooking apparatus 1 of an embodiment of the present disclosure may be configured of a body 10 having a cooking space formed therein, and a door 20 provided to be opened and closed in the front of the body 10 to selectively open the cooking space.

The body 10 has a space opened frontward, and the cooking space can be exposed through the opened front. Further, although not described in detail, there may be provided in the body 10 constructions such as a magnetron, a heater or a burner, which can cook foods in the cooking space.

The door 20 is formed to open and close the opened front of the body 10, which may be turned when pulling a handle 21 provided in the front of the door 20. The door 20 forms a front exterior of the cooking apparatus 1 when it is closed.

Further, there may be provided a control assembly 30 beside the handle 21. The control assembly 30 is used to set and operate the cooking apparatus 1, which may be arranged in the front of the body 10 in order that a user can operate it with ease.

The control assembly 30 is positioned beside the door 20, which corresponds to the door 20 in the vertical length and forms the remaining front exterior of the cooking apparatus 1, which is not covered by the door 20.

Hereinafter, the control assembly is described in detail with reference to the drawings.

Figure 2:
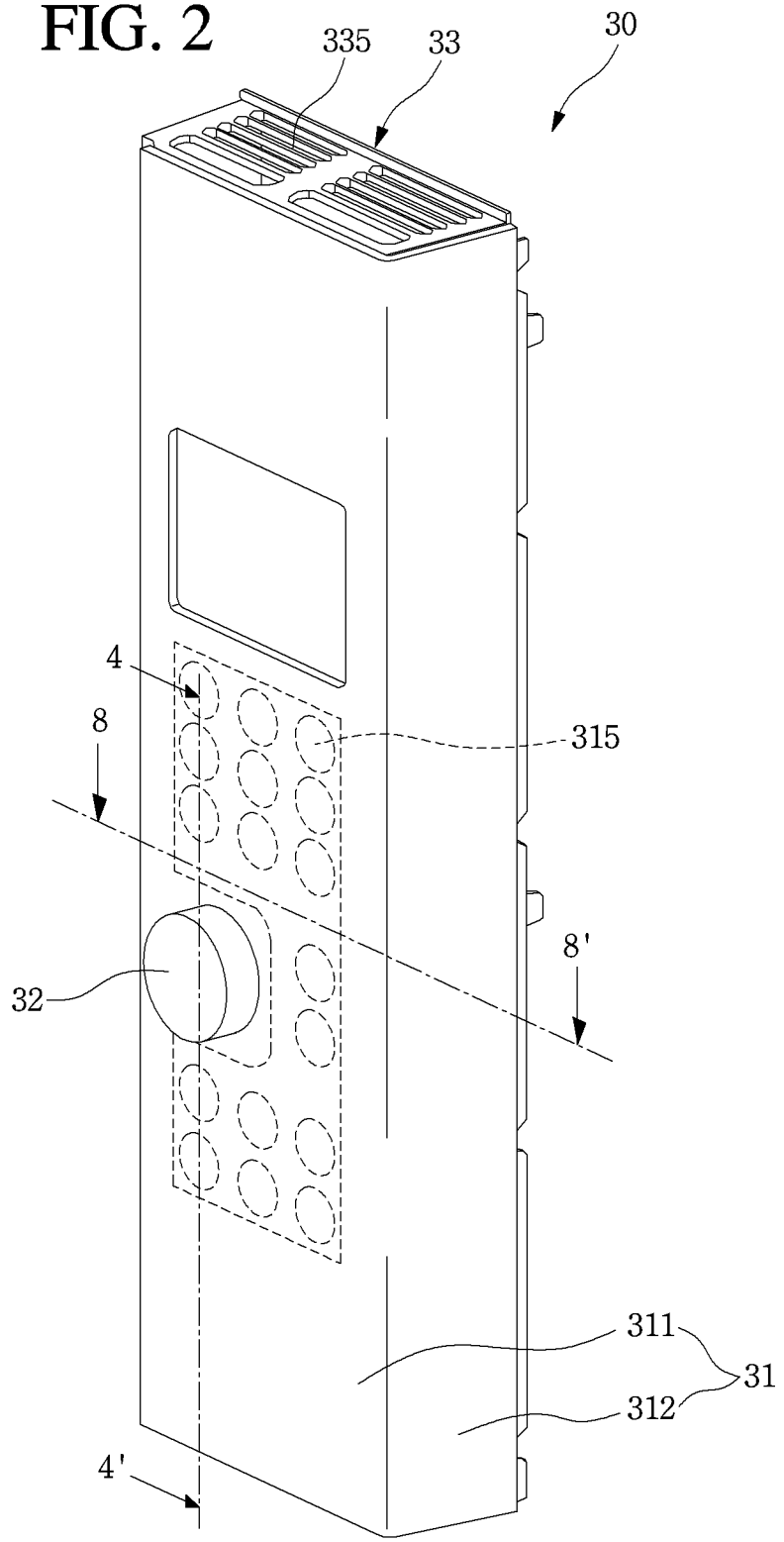
FIG. 2 is a perspective view of a control assembly of the cooking apparatus.
Figure 3:
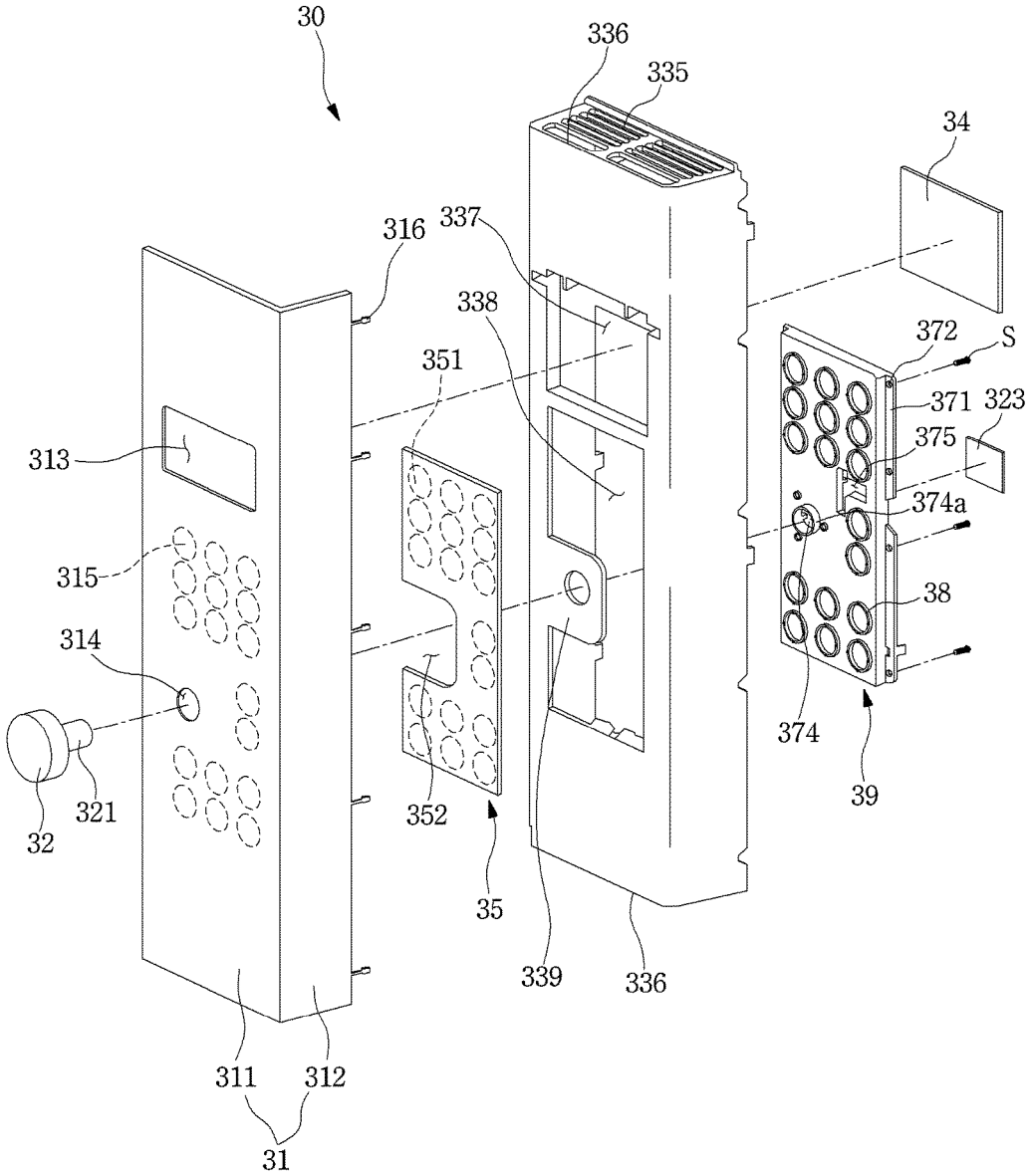
FIG. 3 is an exploded perspective view of the control assembly.
Figure 4:
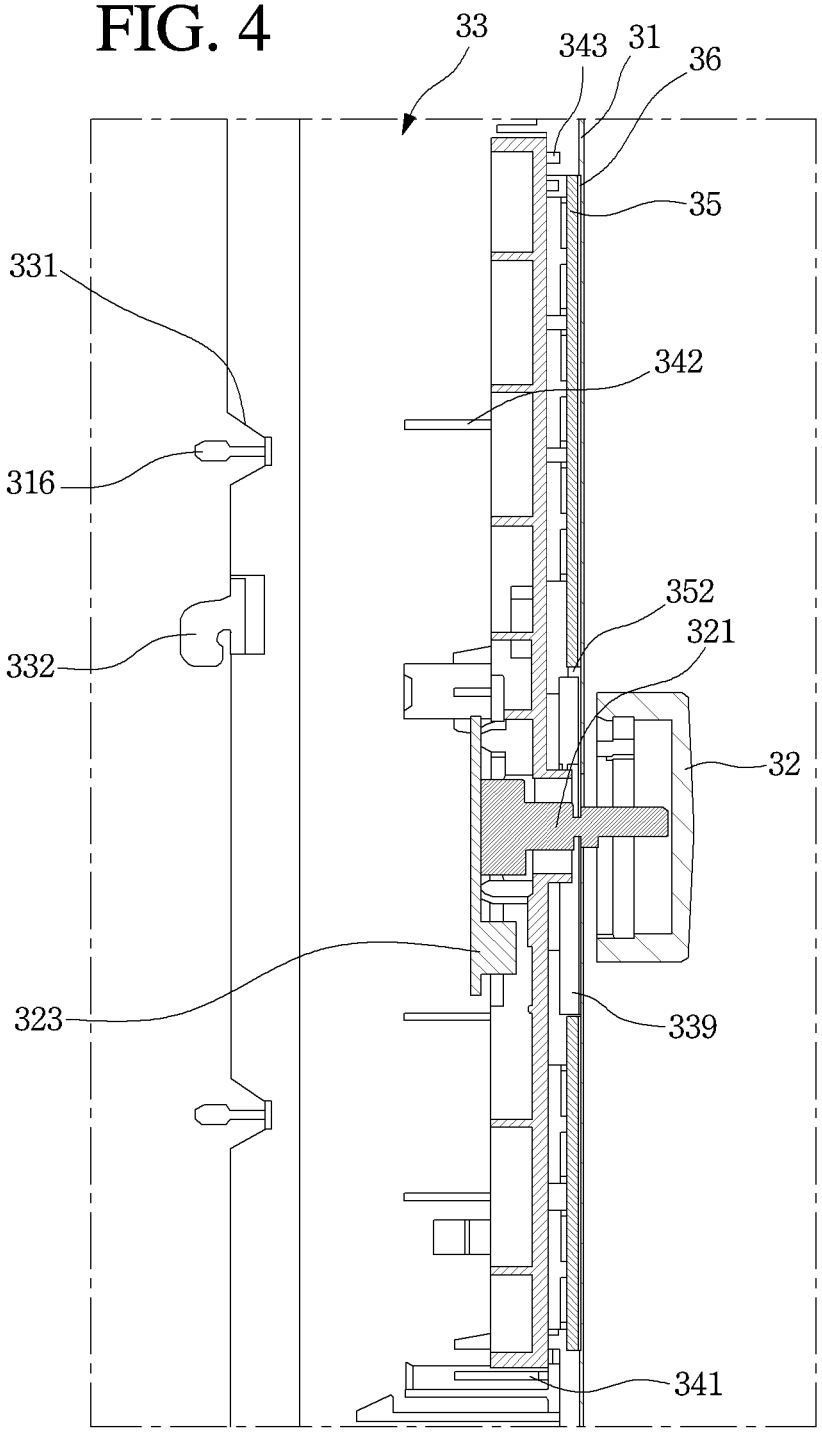
FIG. 4 is a sectional view cut in line 4-4' in FIG. 2.
Figure 5:
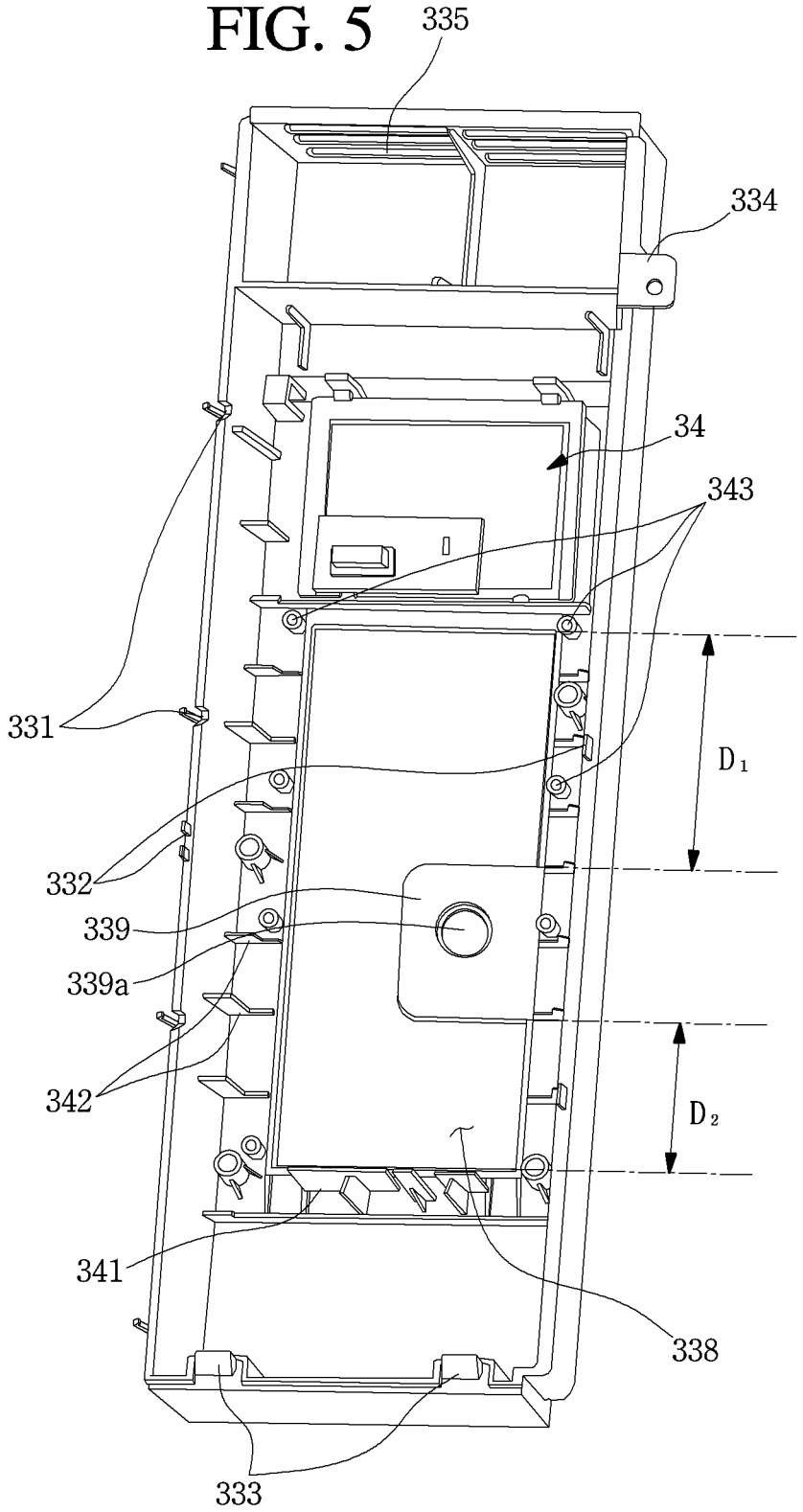
FIG. 5 is a perspective view illustrating that a printed circuit board is mounted on the control assembly.

FIG. 2 is a perspective view of a control assembly of the cooking apparatus. Also, FIG. 3 is an exploded perspective view of the control assembly. Also, FIG. 4 is a sectional view cut in line 4-4' in FIG. 2. Also, FIG. 5 is a perspective view illustrating that a printed circuit board is mounted on the control assembly.

Referring to the drawings, the control assembly 30 may be configured of a cover plate 31 forming an exterior of the control assembly 30, and a body panel 33 coupled with the cover plate 31 and having a printed circuit board 35, a supporter 39 and a display 34 mounted thereon.

In detail, the cover plate 31 forms an exterior of the control assembly 30, which may be formed of stainless or a metal material. Accordingly, the cover plate 31 may be formed of the same material as the door 20, so that the exterior of the cooking apparatus 1 is of a metal texture totally.

Also, the cover plate 31 may be curved to form a front 311 and a side 312 on the same line with outer surfaces of the door 20 and the body 10, and may partially form the exteriors of the front and side of the cooking apparatus 1.

The opposite ends of the front 311 and the side 312 of the cover plate 31 have a number of fixtures projecting at regular intervals, and the fixtures may be bent when the cover plate is coupled with the body panel 33, thereby covering the circumference of the body panel 33.

The cover plate 31 has a display window 313 opened in the upper side of the front thereof. The display window 313 is opened to expose the display 34 used to output operating and setting states of the cooking apparatus 1.

The cover plate 31 may further have a knob hole 314 formed in the front thereof. The knob hole 314 is prepared to mount a knob 32 to set operations of the cooking apparatus 1 and operate it, which is opened in a position where the knob 32 may be mounted so that a rotational axis of the knob 32 may pass through the knob hole 314.

Also, the cover plate 31 may further have an operating unit 315 formed in the front of it so as to display portions that a user operates by touch. The operating unit 315 is formed on the surface of the cover plate 31, which is made by a printing, a film attachment, an etching or a surface processing, indicating portions that a user operates by touch.

That is, the operating unit 315 may be formed in a position corresponding to that of a touch sensor 351 mounted on the printed circuit board 35, and in the number corresponding to that of a plurality of touch sensors 351. Also, the operating unit 315 may be indicated in symbol, character and etc., so that a user may select a desired function. Further, the sensing area may be indicated in a circle shape to correspond to that of the touch sensor 351 so that a user may be led to touch properly.

The body panel 33 may be coupled with the cover plate 31, and fixedly mounted on the front of the body 10. The body panel 33 may be injection molded of a plastic material. The body panel 33 is formed of a front and a circumferential surface extended along a circumference of the front, which forms a structure on which the cover plate 31 and the printed circuit board 35 may be mounted.

For this, a stepped portion 336 is formed along upper and lower ends of the body panel 33, and an end of the cover plate 31 is tightly contacted with the stepped part 336 to be coupled with the body panel 33 while maintaining a correct position.

A fixture groove 331 is formed around the body panel 33, and the fixture 316 is bent and inserted into the fixture groove 331. Also, a mounting hook 332 may further be formed at a portion where the end of the body panel 33 contacts with the front of the body 10, with which the body panel 33 is fixedly mounted on the body 10.

A locking unit 333 may further be formed in the lower end of the body panel 33, which temporally locks the body panel 33 to the body 10. Also, a screw clamping unit 334 may be formed in a side of the end of the circumference surface of the body panel 33, the screw clamping unit 334 being clamped to a screw S used to couple the body panel 33 and the body 10 together.

A grill unit 335 may be formed on the upper surface of the body panel 33. The grill unit 335 enables an inner space and an outer space of the control assembly 30 to be communicated, which is configured of a number of holes so that an air flow is made possible.

A display opening 337 is formed on the front of the body panel 33, through which the display 34 is mounted, and a printed circuit board opening 338 is formed in a lower portion of the display opening 337, through which the printed circuit board 35 is mounted.

Meanwhile, the printed circuit board 35 serves to mount a touch sensor 351 thereon to sense operations made by a user, which provides a space to mount a number of touch sensors 351, and process signals inputted from the touch sensor 351. Of course, the printed circuit board 35 may be formed of a board shaped film material according to the need, and may also be provided as other structure on which the touch sensor 351 may be mounted.

The touch sensor 351 mounted on the printed circuit board 35 may be configured of a piezo type sensor that changes the quantity of electricity depending on the change of the input pressure. Accordingly, when the cover plate 31 is deformed by a touch operation of a user, the quantity of electricity changes as the pressure applied to the touch sensor 351 changes and accordingly the operation of the touch sensor 351 is sensed. Due to such a characteristic of the touch sensor 351, when the cover plate 31 formed of a metal material is operated, it may be sensed effectively.

The front of the printed circuit board 35 may pass through the printed circuit board opening 338 and be tightly contacted with the rear surface of the cover plate 31, the front of the printed circuit board having the touch sensor 351 mounted thereon. Here, the touch sensor 351 is fixedly mounted on a position that corresponds to that of the operating unit 315 on the cover plate 31.

For this, a bonding member 36 may be provided on the rear surface of the cover plate 31 or on the front surface of the printed circuit board 35, and the rear surface of the cover plate 31 and the front surface of the printed circuit board 35 are completely and tightly contacted each other. Here, the bonding member 36 may be formed in a sheet shape, such as a double-sided tape, and also may be formed by applying a bonding material.

The printed circuit board 35 should be correctly arranged on a designated position to precisely recognize operations of the operating unit 315. Also, it may not be possible to change the mounting position of the printed circuit board 35 due to the bonding member 36 once it is mounted. Therefore, the printed circuit board 35 is mounted on a correct position by the guidance of the printed circuit board opening 338.

For this, the printed circuit board opening 338 may be formed correspondingly to a shape of the printed circuit board 35 in order to guide the mounting of the printed circuit board. Also, the printed circuit board opening is asymmetrically formed in the vertical or horizontal direction so that it is prevented to erroneously mount the printed circuit board 35.

Further, a knob mounting unit 339 projecting inwards is formed in the printed circuit board opening 338. The knob mounting unit 339 has a mounting hole 339*a*, through which a rotational axis 321 of the knob 32 passes. Also, there is provided a knob printed circuit board 323 in the rear side of the knob mounting unit 339 and the rotational axis 321 of the knob 32 is mounted on the knob printed circuit board 323 so that a signal may be generated by operating the knob 32.

Accordingly, as illustrated in FIG. 5, while the printed circuit board opening 338 is generally formed to be opened in a rectangle shape, the knob mounting unit 339 is formed in a shape that it projects inwards from the side end of the printed circuit board opening 338.

Further, here, by making a vertical width D1 of the upper area different from that D2 of the lower area with the knob mounting unit 339 as the reference, the printed circuit board 35 is guided to be insertedly mounted in a single direction in principle.

According to the shape of the printed circuit board opening 338 shaped by the knob mounting unit 339, a parting unit 352 dent inwards may further be formed in a shape corresponding to that of the knob mounting unit 339 in one side of the printed circuit board 35.

A printed circuit board supporting unit 341 may be projectedly formed in the outer lower end of the printed circuit board opening 338, which supports the lower end of the printed circuit board 35. Also, there is provided a number of reinforcing ribs 342 from the outer sides of the display opening 337 and the printed circuit board opening 338 to the circumference of the body panel 33 so that the front surface of the body panel 33 is prevented from being deformed or broken.

Also, there is provided a supporter boss 343 in the outer side of the printed circuit board opening 338, which enables the supporter 39 to support the printed circuit board 35 in the rear side, to be mounted. A number of the supporter bosses 343 may be formed along the circumference of the printed circuit board. Further, the supporter boss 343 may be projectedly formed to support the supporter 39 and at the same time clamp the screw S that passes through the supporter 39.

Figure 6:
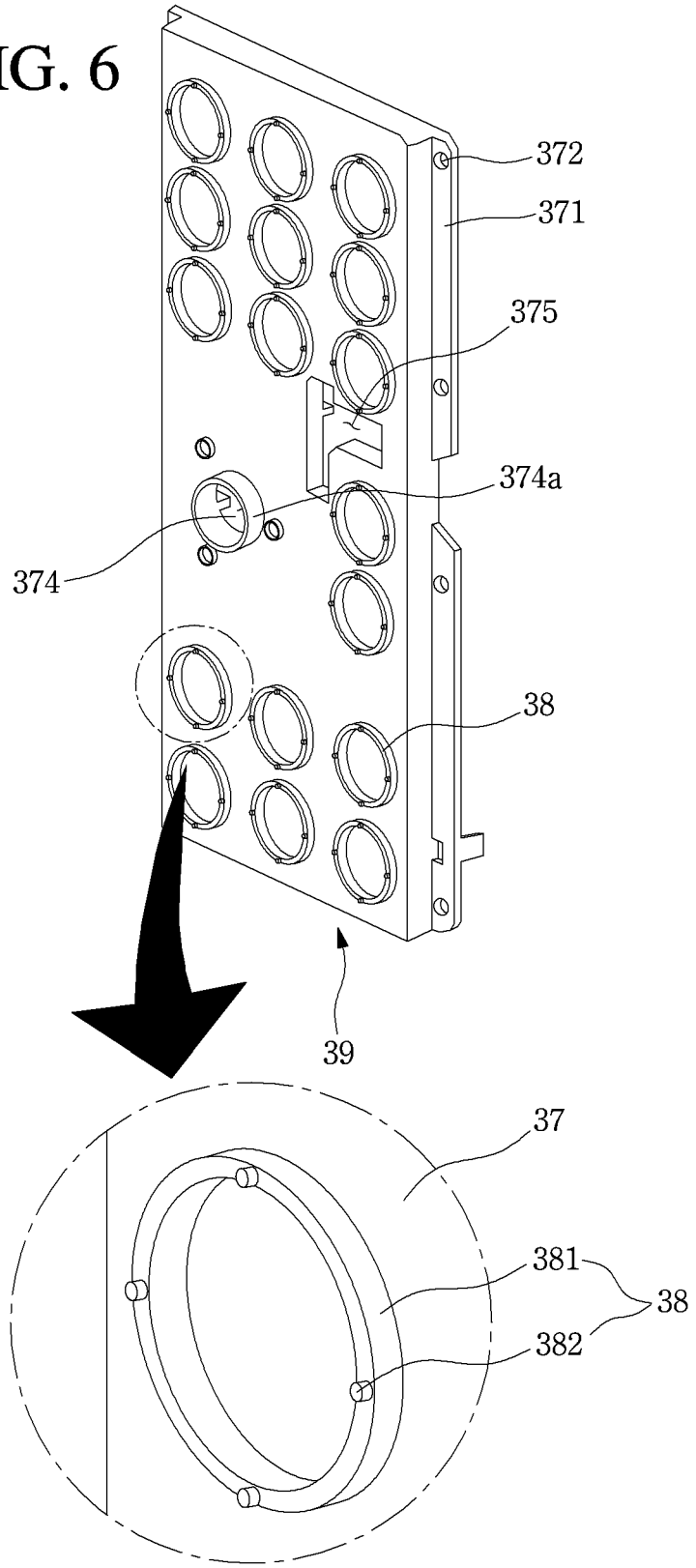
FIG. 6 is a partially perspective view of a supporter that is a main construction of the control assembly.
Figure 7:
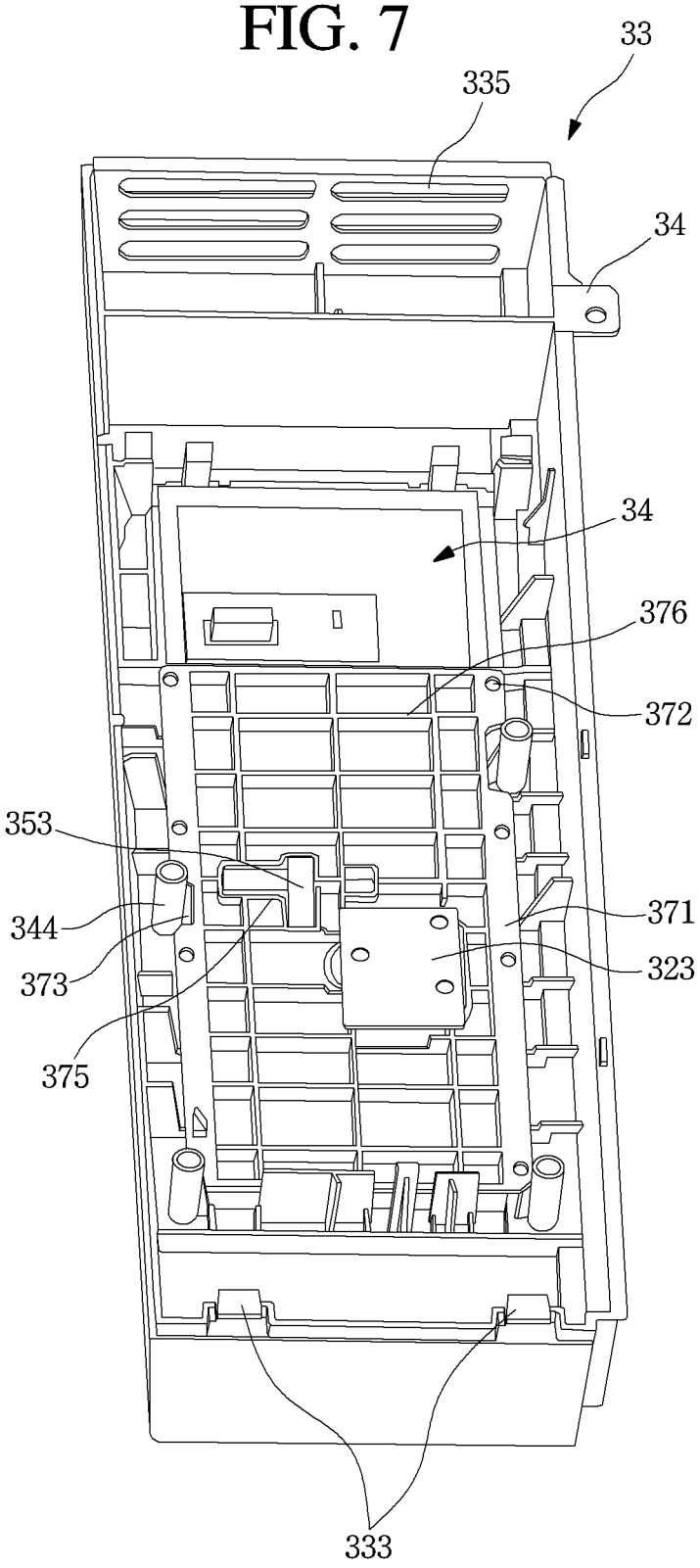
FIG. 7 is a perspective view illustrating that the supporter is mounted on the control assembly.
Figure 8:
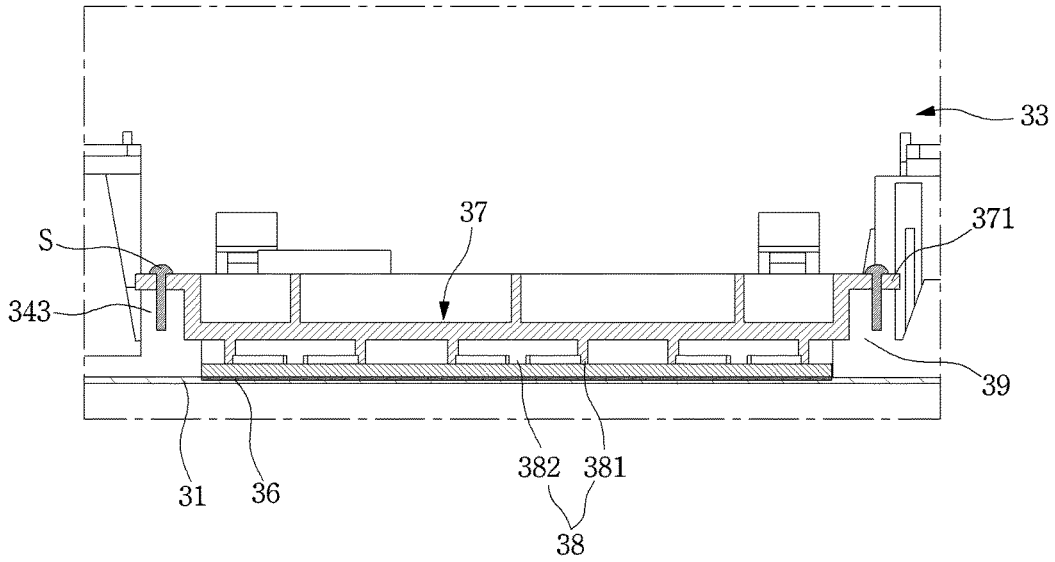
FIG. 8 is a sectional view cut in line 8-8' in FIG. 2.

FIG. 6 is a partially perspective view of a supporter that is a main construction of the control assembly. Also, FIG. 7 is a perspective view illustrating that the supporter is mounted on the control assembly. Also, FIG. 8 is a sectional view cut in line 8-8' in FIG. 2.

As illustrated in the drawings, there is provided a supporter 30 in the rear side of the printed circuit board 35 in the state that the printed circuit board is mounted. The supporter 39 may be formed in the size to cover the printed circuit board 35 in the rear side so that the printed circuit board 35 may tightly be contacted with the cover plate 31 by pressing the entire rear surface of the printed circuit board 35 to the cover plate 31.

The supporter 39 may be formed in a plate shape, and of a silicon, a rubber or a synthetic resin material having elasticity in order to press the cover plate 31. That is, the supporter 39 is formed to press the printed circuit board 35 in the rear side in the state that it is coupled with the body panel 33, so that the printed circuit board 35, that is, the touch sensor 351 is tightly contacted with the cover plate 31.

Further, the supporter 39 may be configured of a base 37 that is generally shaped in a rectangular plate and a number of supporting parts 38 projecting from the base 37.

In detail, the base 37 forms a general shape of the supporter 39, which is formed in a shape of rectangular plate greater than the printed circuit board 35 more or less so as to cover the printed circuit board 35 in the rear side.

Further, the rear surface of the base 37 has a shape dent generally, in which a number of reinforcing rib 37 having a lattice structure are formed. Accordingly, the base 37 may generally have an electricity and at the same time a stable supporting structure.

A supporter mounting unit 371 is formed on the left and right ends of the base 37. The supporter mounting unit 371 extends in a desired length, and has a screw hole 372 through which a screw S may pass. The screw S passes through the screw hole 372 to be clamped to the supporter boss 342 of the body panel 33 so that the supporter 39 may be fixedly mounted.

Also, the supporter mounting unit 371 may further have a supporter denting unit 373, which is dented so that the panel supporting unit 344 extending from the body panel 33 and contacted with the body 10 passes through the supporter denting unit 373. The panel supporting unit 344 contacts with the front surface of the body 10 to support the front surface of the body panel 33 when mounting the body panel 33.

Meanwhile, one side of the base 37 has an axis through hole 374 through which the rotational axis 321 of the knob 32 passes, and further has a screw hole 372 along the circumference of the through hole 374, to which the knob printed circuit board 323 is mounted.

Accordingly, the knob printed circuit board 323 may be positioned in the rear surface of the base 37 and fixedly mounted by the screw S passing through the screw hole 372.

Here, a through hole rib 374*a* may be connected to circumferences of the front and rear surfaces of the axis through hole 374, and the knob 32 and the knob printed circuit board 323 may maintain an interval each other without any interference.

Further, the other side of the base 37 may have a connector hole 375 through which a connector 353 included in the printed circuit board 35 is exposed. The connector 353 is exposed through the connector hole 375 in the rear side, and the connector hole 375 serves wires to be connected to the connector 353 so that the printed circuit board 35 is provided with communication and power supply.

Meanwhile, a number of supporting parts 38 are formed in the front surface of the base 37. The supporting part 38 is positioned on the same line as the operating unit 315 and the touch sensor 351 to support the corresponding area of the printed circuit board 35.

For this, the supporting part 38 may be configured of the rib 381 having a circle shape extending forward and a projection 382 positioned at an extended end of the rib 381 and contacting directly with the rear surface of the printed circuit board 35.

The rib 381 is formed in a circle shape along the outer side of the touch sensor 351, and projected at a desired height. The diameter of the rib 381 may be equal to or greater a little bit than that of the touch sensor 351. Accordingly, when a user operates the operating unit 315 by touch, a displacement may be easily transferred to the touch sensor 351.

Further, the projection 382 is projectedly formed at the extended end of the rib 381. A number of the projections 382 are arranged at regular intervals to support the printed circuit board 35 in the rear side. Here, the projection 382 contacts with the printed circuit board 35 at a point or a desired area, so as to elastically support the printed circuit board 35.

The supporter 39 is coupled with the body panel 33 after mounting the printed circuit board 35, and when mounting the supporter 39, it presses the printed circuit board 35 in the rear side so that the printed circuit board 35 is tightly contacted with the cover plate 31.

Hereinafter, there will be described an assembling method of a control assembly having the structure described above and its operations according to an embodiment of the present disclosure.

The assembled control assembly 30 is mounted on the body 10 of the cooking apparatus 1.

In order to assemble the control assembly 30, first, the molded cover plate 31 and the body panel 33 are coupled each other. Here, the fixture 316 of the cover plate 31 is bent to be received in the fixture groove 331, and the upper end and lower end of the cover plate 31 are tightly contacted with the stepped part 336 so that the cover plate and the body panel 33 may be coupled each other at a correct position.

In such a state, the printed circuit board 35 is mounted on the printed circuit board opening 338. Here, the printed circuit board 35 is formed in a shape corresponding to that of the printed circuit board opening 338, and especially the printed circuit board 35 may be insertedly mounted in the correct direction since it can be recognized without any confusion by the knob mounting unit 339.

Further, since the printed circuit board opening 338 is formed in a shape corresponding to that of the printed circuit board 35, the printed circuit board 35 may be tightly contacted with the cover plate 31 at a correct position by being inserted into the printed circuit board opening 338.

Here, the bonding member 36 is provided to at least one of the front surface of the printed circuit board 35 and the rear surface of the cover plate 31, and the cover plate 31 and the printed circuit board 35 may be completely attached together by the bonding member 36.

In the state that the printed circuit board 35 is completely mounted, a user fixedly mounts the supporter 39 on the body panel 33. Here, the supporter 39 is fixed to the body panel 33 by the screw S clamped to the supporter boss 343. Also, in the state that the supporter 39 is completely fixed to the body panel 33, it presses the printed circuit board 35 in the rear side to be tightly contacted with the cover plate 31.

Further, the assembling is completed by connecting the wire to the printed circuit board connector 353, fixedly mounting the display 34 on the body panel 33, and fixedly mounting the body panel 33 coupled with the cover plate 31 on the front surface of the body 10.

Figure 9:
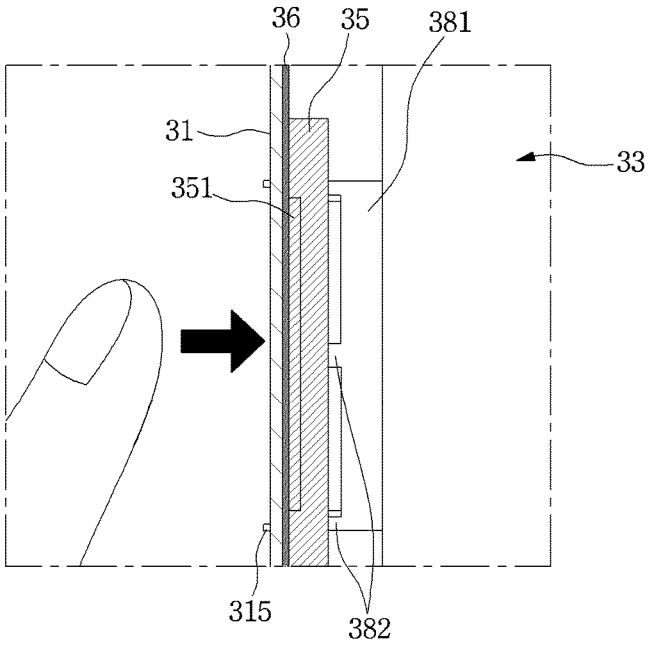
FIG. 9 is a view illustrating a state in which the control assembly is touched.

FIG. 9 is a view illustrating a state in which the control assembly is touched.

As illustrated in the drawing, in the state that the control assembly 30 is completely assembled, the printed circuit board 35 is completely and tightly contacted with the supporter 39. Further, the printed circuit board 35 can be positioned in a correct position by the printed circuit board opening 338.

Accordingly, in the state that the control assembly 30 is completely assembled, the touch sensor 351 is positioned in the position corresponding to that of the operating unit 315, so that a displacement of the cover display 34 caused by the operation of the operating unit 315 can be correctly transferred to the touch sensor 351.

Further, the touch sensor 351 may be elastically supported by the supporter 39 supporting the outer circumference of the touch sensor 351 to be tightly contacted with the cover plate 31. Accordingly, the touch sensor 351 may effectively sense the displacement of the cover plate 31 by the touch operation of a user.

Here, the projection 382 of the supporter 39 presses the printed circuit board 35, and the position where the projection 382 presses the printed circuit board 35 is an outer end of the touch sensor 351 or a point outer than the touch sensor 351 more or less.

Accordingly, when a user operates an area other than the area of the operating unit 315, the pressing power is transferred to the supporter 39 along the projection 382 so that neighboring other touch sensors 351 are prevented from erroneously sensing operations.

That is, when a user correctly operates the area of the operating unit 315, the recognition rate to sense is enhanced. On the other hand, when a user operates areas other than the area of the operating unit 315, the pressing power is dispersed by the supporter 39 so that neighboring touch sensors 351 are prevented from sensing erroneously.

With such operations of the operating unit 315 by a user, the cooking apparatus 1 can perform the operations set.

According to the embodiments of the present disclosure suggested, the following effects are expected.

First, the printed circuit board having the touch sensor may be mounted on the correct position of the cover display operated by a user through the printed circuit board opening of the body panel. Accordingly, since a user can always operate and input by operating the operating unit of the cover display, the operating reliability can be enhanced.

Second, while the printed circuit board can be easily assembled and mounted by synchronizing the shape of the printed circuit board and that of the printed circuit board opening, the printed circuit board is always mounted in one direction by making the shape of the printed circuit board asymmetrical using the knob mounting unit, thereby preventing the mounting error of the printed circuit board occurring while assembling, and making the assembling task easy thereby enhancing the productivity.

Especially, by making the printed circuit board arranged in a correct position without using a separate zig, it may be possible to speed up the assembling and save the installation cost.

Third, the printed circuit board may be pressed forward by the supporter included in the rear surface of the printed circuit board. Here, the supporter of elastic material makes the front surface of the printed circuit board completely and tightly contact with the rear surface of the cover plate. Accordingly, the displacement occurred when a user touches the cover plate may be effectively transferred to the touch sensor, thereby enhancing the recognition rate.

Further, with the press made by the supporter, the cover plate and the printed circuit board are tightly contacted each other. So, even when the bonding member is hardened or does not work properly due to its long-term use, the printed circuit board may maintain a stable mounting state, thereby enhancing the durability.

Fifth, the supporter has a supporting part formed to support the circumference area of the touch sensor in the rear side, so that it tightly presses the touch sensor to the cover plate and at the same time supports the touch sensor. Accordingly, when a user pushes the cover plate, it supports the circumference of the touch sensor by the supporting part to concentrate the displacement to the touch sensor, so that the recognition rate of the touch sensor is enhanced in even higher degree.

Sixth, a number of supporting parts projecting in the supporter are formed in positions corresponding to those of the touch sensors, and the operating unit and the touch sensor of the cover plate, and the supporting part may be arranged on the same extended line. Accordingly, when a user pushes areas other than the operating unit, such as an outer area of the operating unit or an area between the operating units, the power occurred at the push operation is dispersed through the supporting part so that the power is prevented from being transferred to the touch sensor and the recognition error or the undesirable operation caused by the erroneous operation of the operating unit is prevented from being set.

Although embodiments have been described with reference to a number of illustrative embodiments thereof, it will be understood by those skilled in the art that various changes in form and details may be made therein without departing from the spirit and scope of the invention as defined by the appended claims. Therefore, the preferred embodiments should be considered in descriptive sense only and not for purposes of limitation, and also the technical scope of the invention is not limited to the embodiments. Furthermore, is defined not by the detailed description of the invention but by the appended claims, and all differences within the scope will be construed as being comprised in the present disclosure.

What is claimed is:

1. A control assembly, comprising:

a cover plate;

a printed circuit board having a touch sensor attached thereon, the printed circuit board being provided at a rear side of the cover plate;

a body panel that receives the printed circuit board, the body panel being attached to the cover plate;

a printed circuit board opening through which the printed circuit board is inserted into the body panel;

a supporter to support the printed circuit board, the supporter being in contact with the printed circuit board such that the printed circuit board is in contact with a rear side of the cover plate; and a plurality of supporting parts that project from the supporter and support the touch sensor at a rear side of the touch sensor, wherein the plurality of supporting parts are configured to simultaneously support the touch sensor and press the touch sensor against the cover plate when a user pushes the cover plate.

2. The control assembly of claim 1, wherein the shape of the printed circuit board corresponds with the shape of the printed circuit board opening, the shapes being asymmetrical in the vertical and horizontal directions.

3. The control assembly of claim 1, further comprising:

a knob mounting unit provided at the body panel through which a rotational axis of a knob passes, the knob mounting unit having a portion that projects inside the printed circuit board opening.

4. The control assembly of claim 3, wherein a side of the circumference of the printed circuit board comprises a parting unit bent in a shape corresponding to a shape of the knob mounting unit.

5. The control assembly of claim 3, wherein a vertical width of an upper area of the printed circuit board opening is different than a vertical width of a lower area of the printed circuit board opening.

6. The control assembly of claim 3, wherein the body panel further comprises a knob printed circuit board provided at an inner side of the body panel, the knob printed circuit board being coupled with the rotational axis of the knob.

7. The control assembly of claim 3, wherein a lower end of the printed circuit board opening comprises a printed circuit board supporting unit that supports the printed circuit board.

8. The control assembly of claim 1, wherein the supporter that presses against and supports the printed circuit board such that the printed circuit board contacts a rear side of the cover plate.

9. The control assembly of claim 1, wherein the supporter is formed of an elastic material.

10. The control assembly of claim 1, wherein the supporter comprises:

a base having a plate-like shape that corresponds to the printed circuit board; and a plurality of supporting parts that project from the base, the supporting parts corresponding to the touch sensors and supporting an area of the printed circuit board corresponding to a circumference of each of the touch sensors.

11. The control assembly of claim 10, wherein a plurality of reinforcing ribs that form a lattice are provided at a side of the base that is opposite to the supporting part.

12. The control assembly of claim 10, wherein the supporting part includes:

a rib that is provided along the circumference of the touch sensor; and a plurality of projections that are provided along the rib at regular intervals, the plurality of projections being projectedly formed to contact the printed circuit board.

13. The control assembly of claim 12, wherein the diameter of the rib is greater than or equal to the diameter of the touch sensor.

14. The control assembly of claim 12, wherein an operating unit and the touch sensor formed at the cover plate are positioned at an interior area of the rib.

15. The control assembly of claim 14, wherein a center of the operating unit is linear with a center of the touch sensor formed at the cover plate and the supporting part.

16. The control assembly of claim 10, wherein the printed circuit board includes a printed circuit board connector connected to a wire, and the supporter has a connector hole that exposes the printed circuit board connector.

17. A cooking apparatus having a control assembly, comprising:

a body that forms a cooking space;

a door that is attached to the body; and a control assembly provided at a front side of the body, wherein the control assembly includes:

a cover plate;

a printed circuit board having a touch sensor attached thereon, the printed circuit board provided at a rear side of the cover plate;

a body panel that receives the printed circuit board, the body panel being attached to the cover plate;

a printed circuit board opening through which the printed circuit board is inserted into the body panel, the printed circuit board opening having the same shape as a circumference of the printed circuit board; and a supporter to support the printed circuit board, the supporter being in contact with the printed circuit board such that the printed circuit board is in contact with a rear side of the cover plate; and a plurality of supporting parts that project from the supporter and support the touch sensor at a rear side of the touch sensor, wherein the plurality of supporting parts are configured to simultaneously support the touch sensor and press the touch sensor against the cover plate when a user pushes the cover plate.

18. The cooking apparatus of claim 17, wherein the cover plate is formed of a metallic material.

19. The cooking apparatus of claim 17, wherein the body panel is coupled with a front portion of the body, and a front portion of the door and a front portion of the cover plate are positioned along the same plane.

20. The cooking apparatus of claim 19, further comprising:

a plurality of fixtures that are projectedly formed along a circumference of the cover plate; and a plurality of fixture grooves that are formed at the body panel, the fixtures being bent and received in the fixture grooves.

21. The cooking apparatus of claim 19, further comprising stepped parts that are in contact with an upper end and a lower end of the cover plate, the stepped parts being formed at an upper end and a lower end of the body panel, wherein the cover plate is received between the stepped parts.

22. The cooking apparatus of claim 19, wherein a shape of the printed circuit board corresponds with a shape of the printed circuit board opening, the shapes being asymmetrical in the vertical and horizontal directions such that the printed circuit board can be inserted into the printed circuit board opening in a single direction.

23. The cooking apparatus of claim 17, wherein the supporter that presses against and supports the printed circuit board such that the printed circuit board contacts a rear side of the cover plate.

* * * * *